US006772913B2

(12) United States Patent
Garcia et al.

(10) Patent No.: US 6,772,913 B2
(45) Date of Patent: Aug. 10, 2004

(54) FIXING DEVICE AND A DISPENSER USING SUCH A FIXING DEVICE

(75) Inventors: Firmin Garcia, Evreux (FR); Jean-Jacques Ligny, Evreux (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/775,868

(22) Filed: Feb. 2, 2001

(65) Prior Publication Data

US 2003/0205591 A1 Nov. 6, 2003

(30) Foreign Application Priority Data

Oct. 23, 2000 (FR) ..... 00 13567

(51) Int. Cl.[7] ..... B67D 5/32

(52) U.S. Cl. ..... 222/153.09; 222/321.7; 222/402.1

(58) Field of Search ..... 222/153.09, 321.1, 222/321.2, 321.7, 321.8, 321.9, 402.1, 570, 573, 574

(56) References Cited

U.S. PATENT DOCUMENTS 4,773,553 A 9/1988 Brocklin
4,930,688 A * 6/1990 Arona-Delonghi ..... 222/484
5,299,703 A 4/1994 Cater
5,562,219 A * 10/1996 de Pous et al. ..... 215/274
5,941,428 A 8/1999 Behar et al.
6,315,169 B1 * 11/2001 de Rosa ..... 222/321.7
6,463,650 B1 * 10/2002 Bougamont et al. ..... 29/453

FOREIGN PATENT DOCUMENTS

EP 0 806 248 A1 11/1997
FR 81 12102 12/1982

OTHER PUBLICATIONS

Rapport De Recherche Preéliminaire for FR 00.13567 (2 pages).

* cited by examiner

*Primary Examiner*—Joseph A. Kaufman
(74) *Attorney, Agent, or Firm*—Wood, Phillips, Katz, Clark & Mortimer

(57) ABSTRACT

A fixing device for fixing a dispenser member to the neck (41) of a container (4), device comprising a ring (2) forming an annular abutment web (20) serving to come into abutment against the top of the neck, with a gasket (5) optionally being interposed, and a peripheral skirt (21) serving to surround the neck, the skirt forming tabs (22) defining free ends (220), said fixing device being characterized in that each of the tabs is provided with at least one deformation zone (221, 222, 223), the tabs being deformed inwards when thrust is exerted axially on their free ends.

13 Claims, 2 Drawing Sheets

FIXING DEVICE AND A DISPENSER USING SUCH A FIXING DEVICE

TECHNICAL FIELD

The present invention relates to a fixing device for fixing a dispenser member to the neck of a container, and more generally to a fluid dispenser using such a fixing member.

BACKGROUND OF THE INVENTION AND TECHNICAL PROBLEMS POSED BY THE PRIOR ART

When packaging perfumes, cosmetics, or pharmaceuticals, a fluid is frequently packaged in a dispenser which comprises a container forming a reservoir, and a dispenser member in the form of a pump, of a valve, or of some other dispenser head. To fix the dispenser member to the container, in general at the neck thereof, it is known that fixing devices can be used that fix the dispenser on the neck of the container in sealed manner.

Several techniques exist to enable fixing devices to fasten to the neck of the container. Three main types of fixing are known, namely screwing, crimping, and snap-fastening. In fixing using screwing, it is necessary for the outside wall of the neck to be provided with a thread. In the crimping and snap-fastening techniques, it is necessary for the outside wall of the neck to have a suitable profile making co-operation possible by snap-fastening or by crimping. In general, it is common to form the neck with a reinforcing rim that projects radially outwards so as to define a bottom ledge that extends inwards to meet a thinner portion of the neck that then connects to a shoulder formed by the body of the reservoir. Such a design is entirely conventional for a container neck. With such a neck as provided with a reinforcing rim and with an bottom ledge, it is possible for snap-fastening or crimping to be achieved under the bottom ledge.

The invention concerns more particularly the snap-fastening type of fixing. Numerous devices already exist for fixing by snap-fastening to a neck provided with a reinforcing rim and with a bottom ledge. That type of snap-fastening fixing device commonly uses a ring forming an annular abutment web that comes into abutment against the top end of the neck, and a peripheral skirt that extends around the neck and that has inwardly-projecting profiles that co-operate with the bottom ledge of the neck. Thus, the ring is fixed on the neck by bearing against the neck via the abutment web, and under the ledge via the profiles formed by the skirt. As indicated above, several techniques exist for bringing the inwardly-projecting profiles of the skirt under the bottom ledge. In a technique described in Document U.S. Pat. No. 4,773,553, an outer band is used that is engaged around the ring, and more particularly around the skirt, in order to deform the skirt under the bottom ledge. The skirt may be formed by a continuous cylinder, but it may also be in the form of peripheral tabs that are laterally aligned with one another. Before the band is engaged, the skirt has outwardly-extending projections that are displaced by creep of the material over the bottom ledge, this being achieved by forcing the band down onto the ring. In that technique, the band is used to deform a portion of the skirt from the outside inwards under the bottom ledge. Other techniques exist, such as, for example, the technique described in Document FR 2 769 860 which concerns a fixing system in which the skirt of the ring is provided with a continuous inwardly-projecting bead that comes into engagement under the bottom ledge by force. In that fixing system, the band that covers the ring does not take part in the fixing under the bottom ledge, but rather it serves a purely esthetic purpose by masking the fixing ring. It should be noted that, with that fixing system, when the inwardly-projecting snap-fastening bead passes over the reinforcing rim of the neck, the ring is caused to expand, so that it is no longer possible to mount a trim band that comes into contact with the ring at the inwardly-projecting snap-fastening bead. In that document FR 2 769 860, provision is made to form a shoulder in the ring so that a space is created between the band and the skirt of the ring at the snap-fastening bead. Thus, the skirt is free to deform outwards without damaging or being hindered by the trim band.

The fixing achieved by the first system described in Document U.S. Pat. No. 4,773,553 performs very good tamper-proof fixing because the skirt of the ring is locked under the bottom ledge by the band that covers it. However, it is not possible to mount the band on the ring before mounting the ring on a container neck. In addition, while the fixing achieved by the system of Document FR 2 769 860 admittedly does make it possible to mount the trim band on the ring prior to mounting the ring on a container neck, the fixing is not reliable since nothing comes to lock the snap-fastening bead under the bottom ledge. It is therefore possible to withdraw the ring from the neck by exerting some force.

BRIEF SUMMARY OF THE INVENTION

An object of the present invention is to remedy the above-mentioned drawbacks of the prior art by defining a fixing device that is secure and tamper-proof, and that can be put in place on the neck of a container while its trim band is already in place. In addition, neither the ring nor the band need to form a setback so that the band can come into contact with the skirt permanently even while the fixing device is being mounted on the neck of a container.

To achieve this object, the present invention provides a fixing device for fixing a dispenser member to the neck of a container, said device comprising a ring forming an annular abutment web serving to come into abutment against the top of the neck, and a peripheral skirt serving to surround the neck, the skirt forming tabs defining free ends, said fixing device being characterized in that each of the tabs is provided with at least one deformation zone. Advantageously, preventer means are provided surrounding the tabs from the outside so as to prevent the tabs from deforming outwards. The tabs are deformed inwards when thrust is exerted axially on their free ends. The tabs are forced to deform inwards since they are prevented from deforming outwards by the preventer means that may be in the form of a trim band engaged around and preferably in contact with the peripheral skirt. Unlike in Document U.S. Pat. No. 4,773,553, the trim band does not serve to push the tabs of the skirt under the bottom ledge, but rather merely to prevent them from being deformed outwards. The inward deformation of the tabs is generated entirely by the thrust on their free ends.

The invention also provides a fluid dispenser comprising:

- a container defining a body forming a reservoir for the fluid, said body forming a shoulder from which a neck extends, said neck being provided with a reinforcing rim that projects radially outwards so as to define a bottom ledge that extends back inwards to meet a thinner portion of the neck that connects to the shoulder of the body;
- a dispenser member such as a pump or a valve mounted on the neck of the container; and a fixing device for fixing a dispenser member to the neck of the container, said device comprising a ring forming an annular abutment web serving to come into abutment against the top of the neck, and a peripheral skirt serving to surround the neck, the skirt forming tabs defining free ends, said fixing device being characterized in that each of the tabs is provided with at least one deformation zone at the bottom ledge, and in that preventer means are advantageously provided surrounding the tabs from the outside so as to prevent said tabs from being deformed outwards, so that the tabs are constrained to deform inwards under the ledge by means of their free ends bearing against the shoulder of the body when thrust is exerted axially on their free ends.

Advantageously, the deformation zone comprises an outside groove and an inside groove. While the tab is being deformed inwards, the inside groove comes to be received under the bottom ledge, thereby fixing the ring to the neck of the container.

According to a characteristic, the deformation zone comprises an inside rib suitable for pivoting inwards when thrust is exerted axially on the free end of a tab. More precisely, the inside rib comes into engagement under the bottom ledge of the neck not only by pivoting inwards but also by entraining the remainder of the ring downwards, thereby contributing to pressing the abutment web strongly against the top end of the neck. It is thus possible to achieve sealing at the top end of the neck, optionally without using any neck gasket. In a practical embodiment, the rib is defined by two inside grooves.

According to another characteristic, the tabs are separated by non-deformable skirt segments, the free ends of the tabs projecting relative to the skirt segments when the tabs are not deformed, and coming substantially into contact with the shoulder of the body when the tabs are deformed.

The invention is described more fully below with reference to the accompanying drawings which give embodiments of the invention by way of non-limiting example.

DETAILED DESCRIPTION OF THE INVENTION

Figure 3:
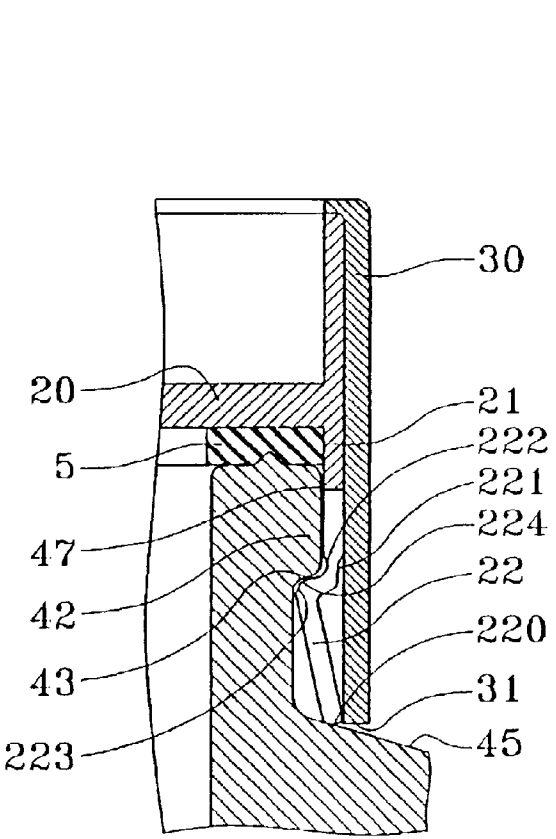
FIG. 3 is a view similar to the view of FIG. 1, with the fixing device of the invention fixed on the neck.
Figure 2:
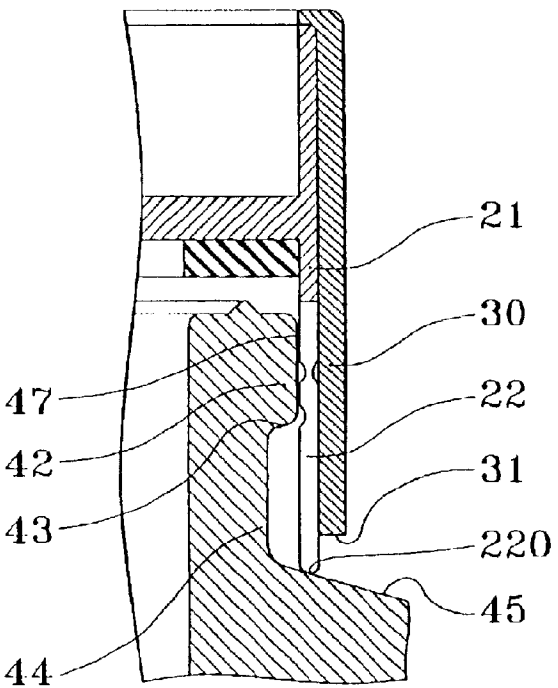
FIGS. 1 and 2 are fragmentary vertical cross-section views through a fluid dispenser of the invention while it is being mounted on a neck.
Figure 1:
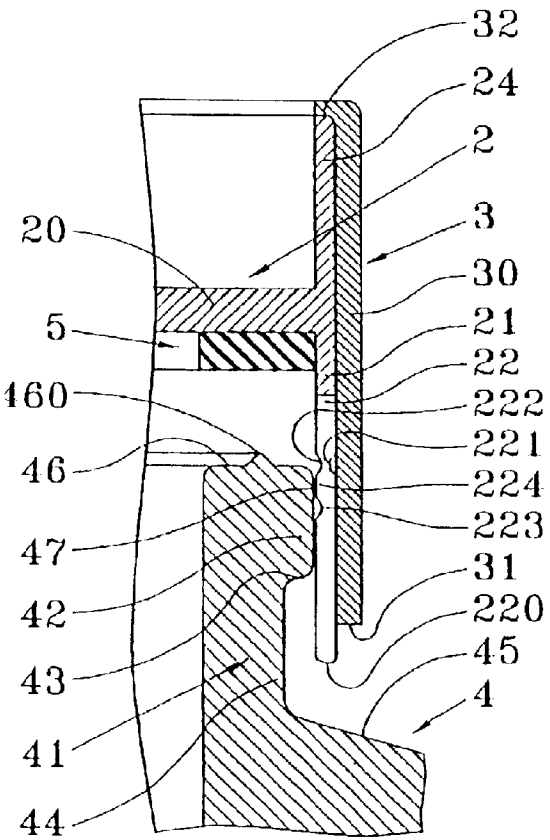

In FIGS. 1 to 3, only the right top portion of a fluid dispenser is shown, with the right portion of a container neck being shown in engagement with a fixing device of which only the right portion is shown. Naturally, the left portions of the neck and of the fixing device are totally identical by mirror symmetry. That is why only the right portion is shown in enlarged form so that the details are shown more clearly.

Overall, the fluid dispenser comprises a container, a dispenser member, e.g. a pump or a valve, and a fixing device for fixing the dispenser member to the container.

The container 4 is of an entirely conventional type, defining a body forming a reservoir for containing the fluid. At its top end, the body forms a shoulder 45 from which a neck extends 41. The neck is provided with a reinforcing rim 42 which projects radially outwards so as to define a bottom ledge 43. The bottom ledge extends inwards to meet a thinner portion 44 of the neck that connects to the shoulder 45 of the body. At its top end 46, the neck 41 forms an annular sealing bead 460.

Numerous containers, flasks or bottles exist that incorporate these characteristics.

The fixing device of the invention makes it possible to fix a pump, a valve or some other form of dispenser head on the neck 41 of the container 4.

For this purpose, the fixing device comprises a ring 2 provided with recess-forming means (not shown) for holding the pump or the valve securely. In general the ring forms a snap-fastening recess into which a collar formed by the body of the pump or of the valve is snap-fastened. The snap-fastening recess forms the central portion of the ring with a hole through which the actuating rod of the pump or of the valve passes. Around the snap-fastening recess (not shown), an annular abutment web 20 extends that serves to come into abutment, with a gasket 5 optionally being interposed, against the top 46 of the neck, so as to crush the gasket 5 or the web 20 against a sealing bead 460. On its outside periphery, the abutment web 20 is connected downwards to peripheral skirt 21, and upwards to a socket 24. The skirt 21 and the socket 24 can be situated in alignment with each other, as shown in FIGS. 1 to 3, so that the outside wall of the ring forms a circular cylinder.

The peripheral skirt 21 has an inside diameter that enables it to engage over the neck 41 of the container 4. In this way, the skirt 21 surrounds the neck 41 so that it fits loosely or with a small amount of clearance. In any event, mounting the skirt on the neck must not be hindered by excessive friction. Since the neck 41 is provided with a reinforcing rim 42 of larger diameter, it can be said that the inside diameter of the skirt 21 is substantially equal to or slightly larger than the outside diameter of the reinforcing rim 42 that forms a cylindrical outside surface 47.

Figure 4:
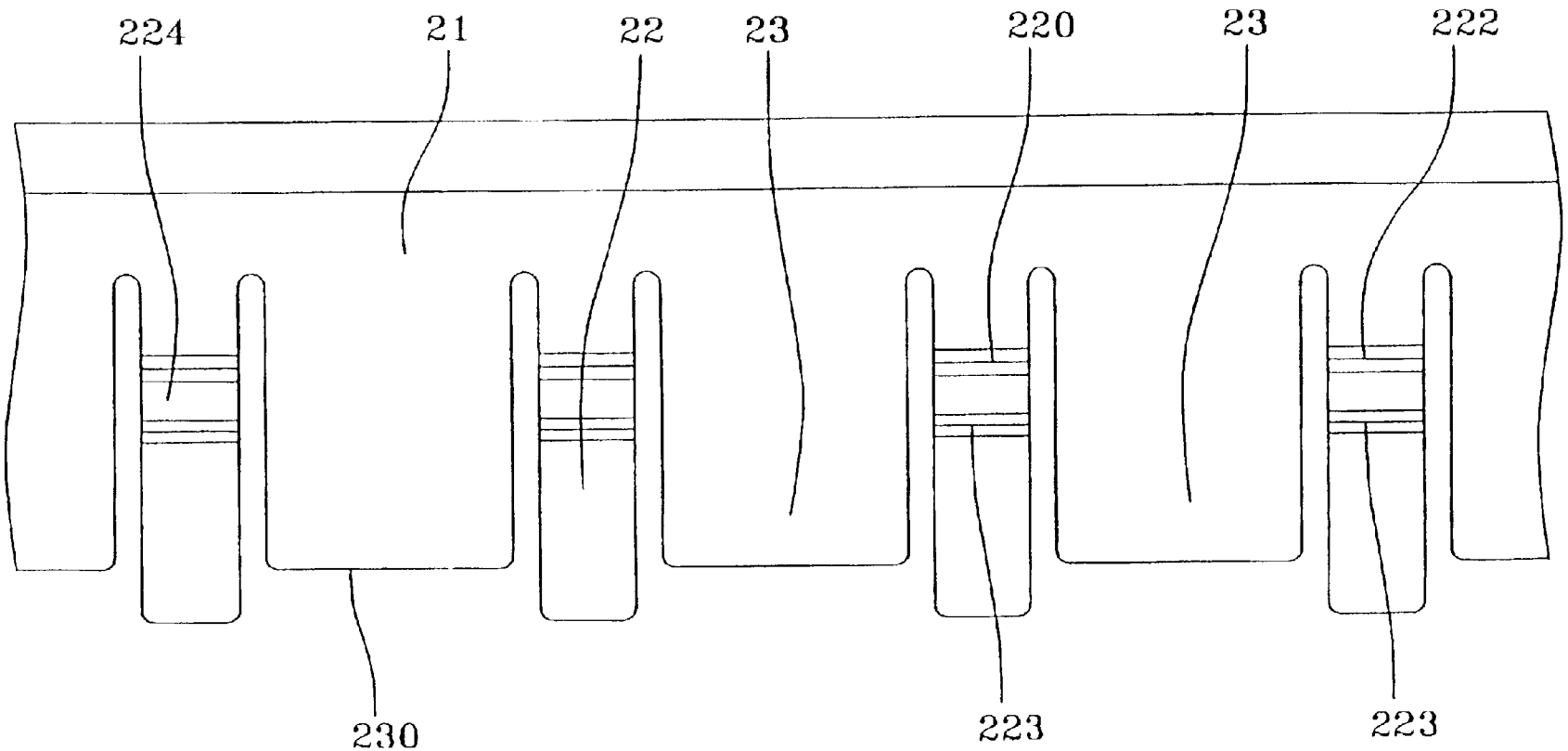
FIG. 4 is a plan view of the inside of the skirt of the fixing device of the invention.

The peripheral skirt 21 further forms tabs 22, each of which is connected via one of its ends to the skirt and extends downwards, as shown in the Figures, to terminate in a free end 220. The tabs 22 may extend side-by-side over the entire periphery of the skirt 21 by being spaced apart by slots, or, in a variant, the tabs 22 may be distributed uniformly over the periphery of the skirt 21 with non-deformable skirt segments 23 interposed between them, as shown in FIG. 4. The tabs 22 extend the continuous portion of the skirt 21 that connects to the abutment web 20. Before being mounted on the neck, neither the skirt 21 nor the tabs 22 nor the skirt segments 23 are of inside diameter smaller than the outside diameter of the neck 41, so that the skirt 21 with its tabs and its skirt segments can be put in place on the neck 41 of the container 4 without being deformed.

In the invention, each of the tabs 22 is provided with at least one deformation zone enabling the tabs to deform inwards under the ledge 43. By deforming inwardly, the tabs 22 reduce the inside diameter of the skirt 21 so that a portion of each of the tabs can be received against the thinner portion 44 of the neck 41 under the ledge 43. The deformed tabs 22 preferably come into bearing contact against the ledge 43 so as to press the abutment web 20 or the gasket 5 strongly against the top 46 of the neck 41, so as to provided sealing thereat.

In the invention, the tabs 22 are deformed by exerting axial thrust on their free ends 220. This is achieved when the free ends 220 of the tabs 22 come into contact with the shoulder 45 of the container 4 while the fixing device is being mounted onto the neck of the container. In FIG. 1, the tabs 22 are not yet engaged fully against the neck of the container: their free ends 220 are still spaced apart from the shoulder 45. In FIG. 2, the ring 2 has not yet reached its final position on the neck 41, but the free ends 220 of the tabs 22 are already in contact with the shoulder 45. By continuing to push axially downwards on the ring 2, it is possible to cause the tabs 22 to undergo deformation because they are in abutment against the shoulder 45 via their free ends 220. This is shown in FIG. 3. The web is then in sealed abutment against the top 46 of the neck, either directly or via the gasket 5, and the tabs 22 are deformed inwards under the ledge 43. Naturally, by being deformed inwardly, the tabs 22 undergo a reduction in height. It is therefore necessary to form the tabs 22 with a length longer than the skirt segments 23, when the embodiment shown in FIG. 4 is chosen. In the extended position, as shown in FIGS. 1 and 2, the free ends 220 of the tabs 22 project downwards relative to the free ends 230 of the skirt segments 23. Once they have been deformed, as shown in FIG. 3, the free ends 220 of the tabs 22 are situated substantially at the same level as the free ends 230 of the skirt segments 23.

Deforming the tabs so that they come into bearing contact against the ledge 43 is made possible by the presence of suitable deformation zones. In the embodiment shown, the deformation zones are in the form of a hinge having preferential fold zones. An outside groove 221 makes it possible for the tab 22 to fold inwards at an angle that corresponds substantially to the angle formed by the ledge 43. To facilitate the inward folding, each of the tabs 22 may also be provided with an inside groove 222. In addition, to enable the tabs 22 to remain substantially vertical, each tab is provided with an additional inside groove 223 situated below the inside groove 222. The second inside groove 223 makes it possible for the tab 22 to fold again to take up a direction substantially similar to the direction of the skirt 21. FIG. 3, for example, shows that the bottom portion of each of the tabs 22 below the groove 223 slopes somewhat outwards and downwards. Between the two inside grooves 222 and 223, the tabs 22 form an inside rib 224 suitable for coming into pressing contact against the ledge 43. The function of these grooves and rib is to enable the tab to deform inwardly to bring EL portion of the tab into pressing contact against the ledge 43 of the neck.

It is also advantageous and desirable for the deformation of the tabs 22 under the ledge 43 to cause axial traction to be applied to the ring 2 so as to press the abutment web 20 against the top 46 of the neck 41. This axial traction is achieved by the deformation of the tabs 22 which come into abutment under the ledge 43. For example, the tabs folding at the inside grooves 223 that are then received immediately under the ledge 43 may cause the grooves 221 and 222 to move downwards so as to achieve this downward axial traction. The rib 224 thus serves as a pivot point under the ledge 43 to pull the web downwards against the top 46 of the neck 41.

In the invention, in addition to the ring 2, the fixing device advantageously further comprises a band 3 engaged around and in contact with the peripheral skirt 21. The band 3 comprises a body 30 forming a bottom end 31 and a top end 32 folded over inwards to bear against the socket 24 of the ring. This band 3 makes it possible to provide esthetically attractive trim for the ring 2. In the present invention, this band 3 also performs an additional function, namely it serves to prevent the tabs 22 of the skirt 21 from deforming outwards. The tabs 22 are thus constrained to deform inwards under the ledge of the neck. To perform this preventer function, the band 3 merely extends along the skirt 21 in contact with the tabs 22 when said tabs are in their extended position, as shown in FIGS. 1 and 2. When the bottom ends 220 of the tabs 22 come into contact with the shoulder 45, as shown in FIG. 2, the band 3 is still in contact with the tabs 22. The tabs 22 cannot therefore deform outwards. By continuing to press on the ring 2, it is possible to cause the tabs 22 to be constrained to deform inwards as shown in FIG. 3 so that they move away from the band 3. In the final position, the bottom end 31 of the band 3 is situated substantially at the same level as the bottom ends 220 of the tabs 22, i.e. in the vicinity of the shoulder 45. At this level, the tabs are in contact with the band which thus prevents the tabs from extending outwards. This stop function for preventing the free ends of the tabs from extending outwards may also be provided by the shoulder, e.g. by providing it with an abutment profile.

It should be noted that the band 3 does not participate directly in deforming the tabs 22, and it does not even lock them under the ledge 43. In addition, it should be noted that the band 3 may be engaged under the ring 2 before the ring 2 is mounted on the neck of a container, as shown in FIGS. 1 to 3. The ring 2 does not need to extend or to expand when it is engaged on the neck, so that its outside diameter is constant throughout the assembly operation. In addition, that portion of the ring which provides fixing to the neck of the container is deformed only once the ring is in its final position on the neck of the container.

In this embodiment, the means used to prevent the tabs from deforming outwards are constituted by the trim band 3. Naturally, other embodiments performing the same function may be considered, e.g. achieved or formed directly by the fixing ring 2, or even by the container 4.

By means of the invention, a fixing system is obtained that is in one or two parts (ring or ring+band), that provides secure and permanent fixing, and that is particularly simple to fit. The technique of fixing to a neck uses abutment against the shoulder of the container to move or to deform a part or a portion of a part under the ledge of the neck.

What is claimed is:

1. A fixing device for fixing a dispenser member to the neck (41) of a container (4), said device comprising a ring (2) forming an annular abutment web (20) adapted to be located at the top of the neck, and a peripheral skirt (21) serving to surround the neck, the skirt forming tabs (22) defining free ends (220), said fixing device being characterized in that each of the tabs is provided with at least one deformation zone (221, 222, 223), the tabs being deformed inwards when thrust is exerted axially on their free ends, said deformation zone comprising an outside groove (221) and an inside groove (223).

2. A fixing device according to claim 1, in which preventer means (3) are provided for preventing the tabs (22) from deforming outwards.

3. A device according to claim 2, in which the preventer means comprise a trim band (3) engaged around and in contact with the peripheral skirt (21).

4. A fixing device for fixing a dispenser member to the neck (41) of a container (4), said device comprising a ring (2) forming an annular abutment web (20) adapted to be located at the top of the neck, and a peripheral skirt (21) serving to surround the neck, the skirt forming tabs (22) defining free ends (220), said fixing device being characterized in that each of the tabs is provided with at least one deformation zone (221, 222, 223), the tabs being deformed inwards when thrust is exerted axially on their free ends, said deformation zone comprising an inside rib (224) suitable for moving when thrust is exerted axially on the free end of a tab.

5. A fixing device for fixing a dispenser member to the neck (41) of a container (4), said device comprising a ring (2) forming an annular abutment web (20) adapted to be located at the top of the neck, and a peripheral skirt (21) serving to surround the neck, the skirt forming tabs (22) defining free ends (220), said fixing device being characterized in that each of the tabs is provided with at least one deformation zone (221, 222, 223), the tabs being deformed inwards when thrust is exerted axially on their free ends, and further comprising a rib (224) being defined by two inside grooves (222, 223).

6. A fixing device for fixing a dispenser member to the neck (41) of a container (4), said device comprising a ring (2) forming an annular abutment web (20) adapted to be located at the top of the neck, and a peripheral skirt (21) serving to surround the neck, the skirt forming tabs (22) defining free ends (220), said fixing device being characterized in that each of the tabs is provided with at least one deformation zone (221, 222, 223), the tabs being deformed inwards when thrust is exerted axially on their free ends, said tabs (22) being separated by non-deformable skirt segments (23), the free ends (220) of the tabs (22) projecting relative to the skirt segments (23).

7. A fluid dispenser comprising:

a container (4) defining a body forming a reservoir for the fluid, said body forming a shoulder (45) from which a neck (41) extends, said neck being provided with a reinforcing rim (42) that projects radially outwards so as to define a bottom ledge (43) that extends back inwards to meet a thinner portion (44) of the neck that connects to the shoulder (45) of the body;

a dispenser member mounted on the neck of the container; and a fixing device (2, 3) for fixing said dispenser member to the neck of the container, said device comprising a ring (2) forming an annular abutment web (20) serving to come into abutment against the top (46) of the neck, and a peripheral skirt (21) serving to surround the neck, the skirt forming tabs (22) defining free ends (220), said fixing device being characterized in that each of the tabs is provided with at least one deformation zone (221, 222, 223) at the bottom ledge, the tabs being deformed inwards under the ledge by means of their free ends bearing against the shoulder of the body.

8. A device according to claim 7, in which preventer means (3) are provided to prevent the tabs from deforming outwards.

9. A device according to claim 8, in which the preventer means comprise a trim band (3) engaged around and in contact with the peripheral skirt (21).

10. A device according to claim 7, in which the deformation zone comprises an outside groove (221).

11. A device according to claim 7, in which the deformation zone comprises an inside groove (223) which is received under the bottom ledge (43).

12. A device according to claim 7, in which the deformation zone comprises an inside rib (224) which comes into engagement under the ledge (43) by pivoting inwards.

13. A device according to claim 7, in which the tabs (22) are separated by non-deformable skirt segments (23), the free ends (220) of the tabs (22) projecting relative to the skirt segments when the tabs are not deformed, and coming substantially into contact with the shoulder of the body when the tabs are deformed.

* * * * *